US005582227A

United States Patent [19]

Schuch et al.

[11] Patent Number: 5,582,227

[45] Date of Patent: Dec. 10, 1996

[54] METHOD AND SYSTEM FOR COATING SURFACES OF A CASELESS MOLD

[76] Inventors: Karin Schuch, Echoer Str. 20, Wuppertal 21, Germany; Harry Post, Tuchstrasse 38, Radevormwald, Germany

[21] Appl. No.: 269,250

[22] Filed: Jun. 30, 1994

Related U.S. Application Data

[63] Continuation-in-part of Ser. No. 66,468, May 25, 1993, abandoned.

[30] Foreign Application Priority Data

Sep. 1, 1992 [DE] Germany ..... 42 28 749.9

[51] Int. Cl.[6] ..... B22C 11/10; B22C 19/00; B22C 23/02

[52] U.S. Cl. ..... 164/15; 164/18; 164/40; 164/149; 164/158; 164/187; 164/267

[58] Field of Search ..... 164/15, 18, 40, 164/149, 158, 187, 267

[56] References Cited

U.S. PATENT DOCUMENTS

| | | | |
|---|---|---|---|
| 3,192,580 | 7/1965 | Lubalin | 164/18 X |
| 4,738,297 | 4/1988 | Takagi et al. . | |
| 4,997,025 | 3/1991 | Post et al. | 164/40 X |

FOREIGN PATENT DOCUMENTS

| | | | |
|---|---|---|---|
| 0278114 | 8/1988 | European Pat. Off. . | |
| 0406753 | 1/1991 | European Pat. Off. . | |
| 2549043 | 4/1977 | Germany . | |
| 3636166 | 9/1987 | Germany . | |
| 285033 | 12/1990 | Germany | 164/267 |
| 4228749 | 6/1993 | Germany . | |
| 1452642 | 1/1989 | U.S.S.R. | 164/267 |

OTHER PUBLICATIONS

Abstract of German Patent 4228749. Patent Date Jun. 9, 1993.

Rimrock airless spray system product literature Jun. 1977.

DISA Technologies product literature Jan. 1992.

Abstract of Japanese Patent Publication 63–273542 Published Nov. 10, 1988.

*Primary Examiner*—J. Reed Batten, Jr.

*Attorney, Agent, or Firm*—Herbert Dubno; Andrew Wilford

[57] ABSTRACT

In a molding system a box has a pair of oppositely open ends has inner side faces and respective mold plates are engageable in the open ends to close same and have faces defining with the inner side faces a mold cavity. Sand is introduced into the cavity between the faces and is compressed in the cavity to form a mold part. An aerosol mist under superatmospheric pressure and comprised of air and finely divided droplets of a coating liquid is sprayed into the mold cavity when same is closed by the mold plates but before the sand is introduced into the cavity so that the droplets settle on the faces and coat same with the liquid.

10 Claims, 6 Drawing Sheets

METHOD AND SYSTEM FOR COATING SURFACES OF A CASELESS MOLD

CROSS REFERENCE TO RELATED APPLICATIONS

This application is a continuation-in-part of application Ser. No. 08/066,468 filed May 25, 1993 and now abandoned.

FIELD OF THE INVENTION

The present invention relates to a method of and apparatus for coating the internal surfaces of a so-called caseless mold. More particularly this invention concerns a system for applying mold-release and/or lubricating liquid to the plates of such a mold used to make sand-mold parts.

BACKGROUND OF THE INVENTION

In the serial production of sand-mold parts it is standard to use a so-called caseless mold which has a normally stationary box with a pair of opposite open ends each of which can be closed by a respective mold plate. When closed the interior surfaces of the box and the confronting faces of the mold plates define a mold cavity which is filled with mold sand, also termed grog, ganister, or chamotte, that is then compressed to take on a shape corresponding to the mold cavity. After compression one of the mold plates is retracted and moved to the side and the mold part is pushed out of the mold by the other mold plate and is separated from this other plate. In some systems a series of such mold parts is then pressed longitudinally together to form a succession of pockets which are filled with molten metal to make the desired articles, for instance wheels.

In order to reduce wear to the interior faces of the mold box and the faces of the mold plates and to facilitate separation of the molded body, it is standard practice to spray them with a liquid, normally mainly oil. This step is essential to limit wear and to make the molded body separate cleanly from the mold faces.

The standard procedure to thus coat the mold faces is simply to spray them with the mold-release/lubricating liquid when the mold is open. This is, obviously, a very messy operation. The oily liquid runs all over the machine, creating a wet mess where grit can lodge and find a home. In addition some of the liquid inherently becomes airborne so that it travels somewhat from the machine to deposit on adjacent structure and be breathed by the workers manning the equipment.

An attempt has been made to limit the dispersion of the coating liquid by spraying it into the mold cavity when it is at least partially closed. It has also been suggested to use an airless liquid-injection system to spray the interior faces of the mold. Such procedures have been found to provide very poor coating action unless a great deal of the liquid is used. This not only wastes the liquid, but can soak the sand being used for the mold part, making it impossible to reuse.

OBJECTS OF THE INVENTION

It is therefore an object of the present invention to provide an improved system for coating the surfaces of a caseless mold.

Another object is the provision of such an improved system for coating the surfaces of a caseless mold which overcomes the above-given disadvantages, that is which confines the coating liquid to the mold surfaces and that uses the liquid economically.

SUMMARY OF THE INVENTION

The instant invention is an improvement on a molding system wherein a box having a pair of oppositely open ends has inner side faces and respective mold plates are engageable in the open ends to close same and have faces defining with the inner side faces a mold cavity. Sand is introduced into the cavity between the faces and is compressed in the cavity to form a mold part. According to the invention an aerosol mist under superatmospheric pressure and comprised of air and finely divided droplets of a coating liquid is sprayed into the mold cavity when same is closed by the mold plates but before the sand is introduced into the cavity so that the droplets settle on the faces and coat same with the liquid.

With this system nothing escapes from the closed mold cavity during the coating operation so that there is no mess outside the machine and none of the coating oil gets into the air where it could be breathed by the operating personnel. The fire hazard created by the mist of oil is largely eliminated, since the mist is wholly confined inside the mold. Furthermore the system produces an extremely uniform coating of the liquid on the important surfaces of the mold cavity. In fact the inventive system can use only 5% as much coating liquid as the prior-art methods while still achieving a wholly satisfactory coating of the mold faces.

According to further features of the invention the mold plates are moved from relatively widely spaced outer positions to relatively closely spaced inner positions and the mist is sprayed from nozzles provided on the box inner faces. The method further has according to the invention the step of blowing air from the nozzles while the mold plates are in the outer positions to clear sand from them. The mist is injected under a pressure of between 4 bar and 10 bar. In addition it is formed outside the cavity and is conducted to the cavity under superatmospheric pressure.

The molding system of this invention has for each nozzle an atomizer outside the box for forming the aerosol mist. Each atomizer is connected to a supply of the coating liquid and a supply of air under pressure. The nozzles are provided in vertical side plates of the box, and may be positioned to provide an extra-thick coating on the floor of the box which is exposed to extreme wear. Each nozzle includes a deflector defining an at least partially annular gap through which the mist is ejected into the cavity.

The spraying is operated by a programmable computer-type controller which is connected to position-detecting switches that supply the controller with information about the positions of the movable mold plates. The number of cleaning and/or spray pulses is determined by the controller in accordance with operating needs. Normally the spraying can be done during the normal closing cycle of the mold press without in any way adding to the cycling time thereof.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
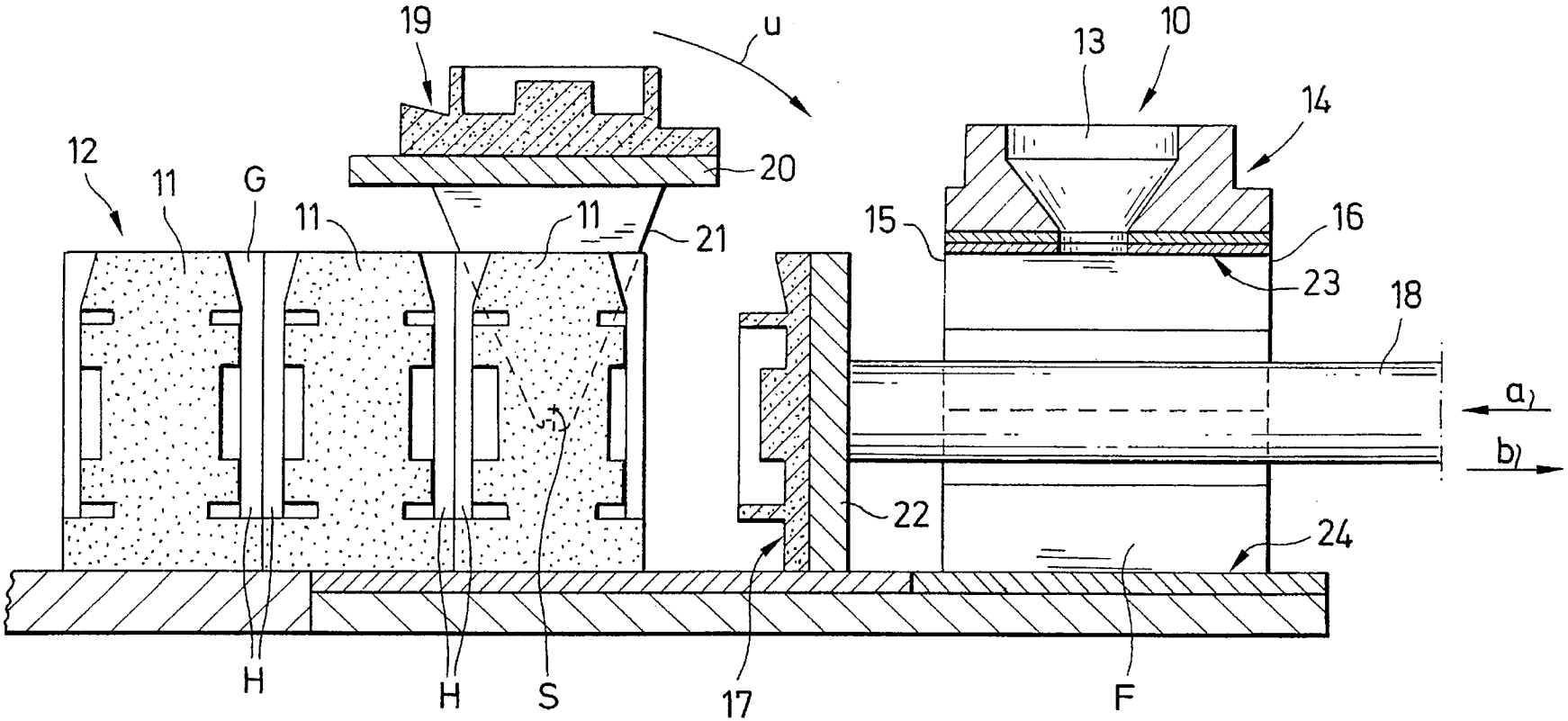
FIG. 1 is a partly diagrammatic longitudinal and vertical section through the system of this invention.
Figure 2:
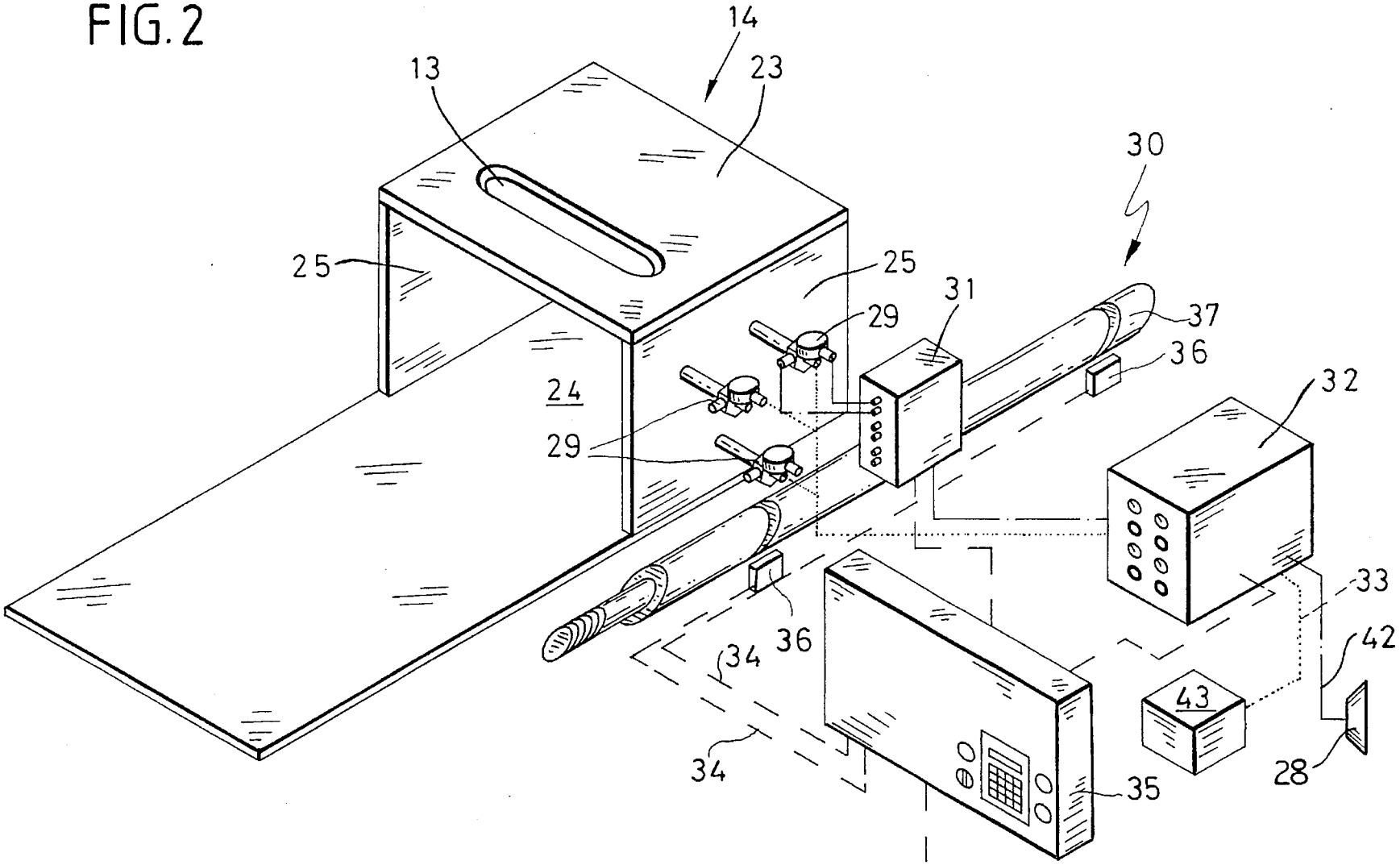
FIG. 2 is a diagrammatic perspective of the system.

As seen in FIGS. 1 and 2, mold parts 11 of a mold string 12 are made in a caseless mold 10 basically comprised of a box 14 and a pair of end mold plates 17 and 19. The mold parts 11 form hollows or cavities H which are upwardly open through gates G into which liquid metal can be poured to form workpieces, here solid flywheels. The actual formation of such workpieces is standard and is not relevant to the invention at hand, which relates to the operation of the machinery that makes the sand-mold parts 11.

The box 14 is formed in its top with an input funnel or opening 13 by means of which mold sand can be introduced into it. This box 14 has a downstream open end 15 and an upstream open end 16, relative to a normal direction a, and its tunnel-like interior is defined by a pair of vertical side walls 25, a horizontal top wall or ceiling 23, and a horizontal bottom wall or floor 24. The upstream opening 15 can be closed by a mold plate 17 carried in turn on a backing plate 22 itself mounted on piston rods 18 of four cylinders 37 one of which is shown in FIG. 2. The downstream opening 15 can be blocked by a downstream mold plate 19 carried on a backing plate 20 itself mounted on a support 21 for pivoting as shown by arrow u about a horizontal axis S and movement in the travel direction a and against it as illustrated by arrow b. The plates 17 and 19 have contoured faces that define the hollows H in the finished mold string 12.

Figure 3:
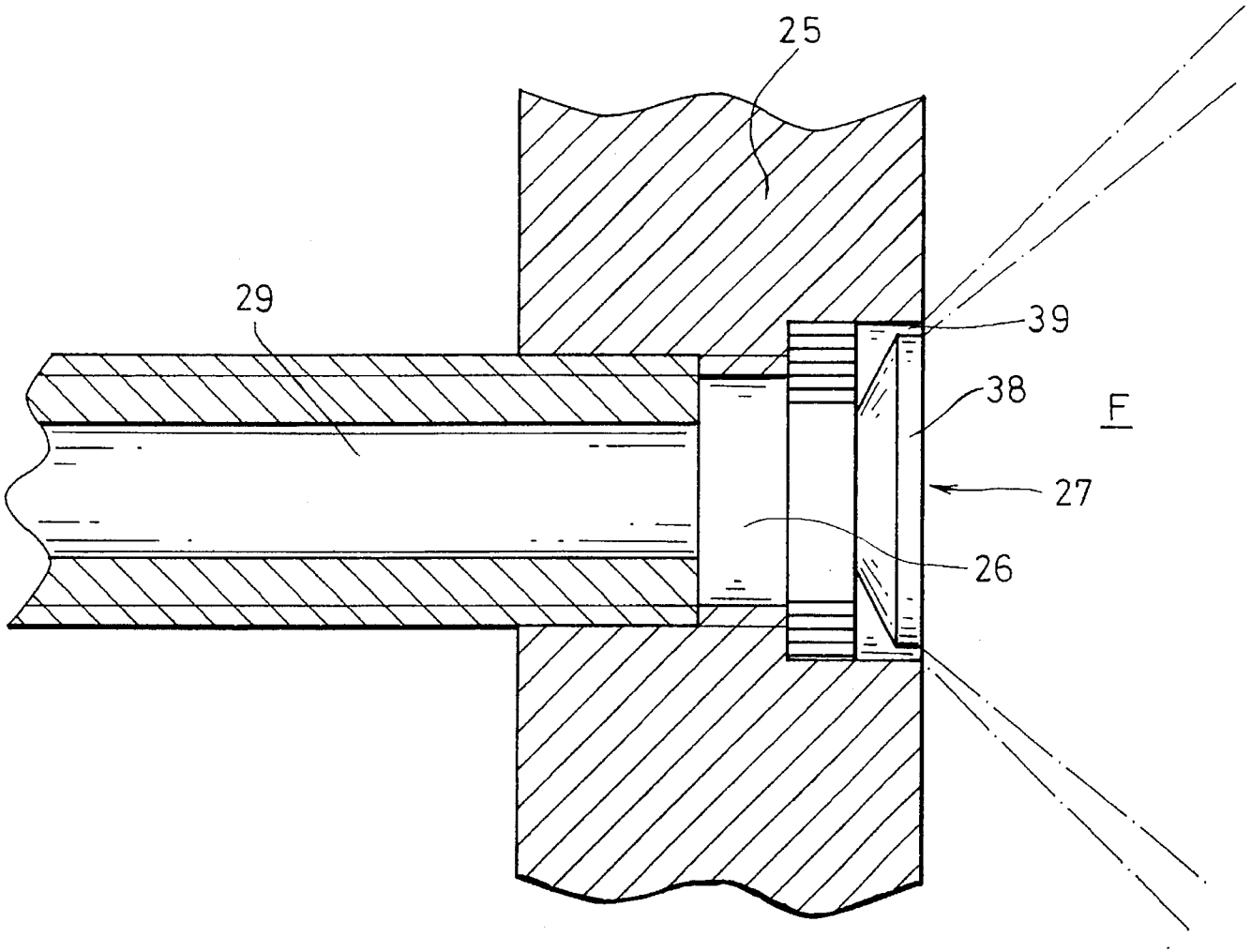
FIG. 3 is a large-scale view of a detail of the system.
Figure 4:
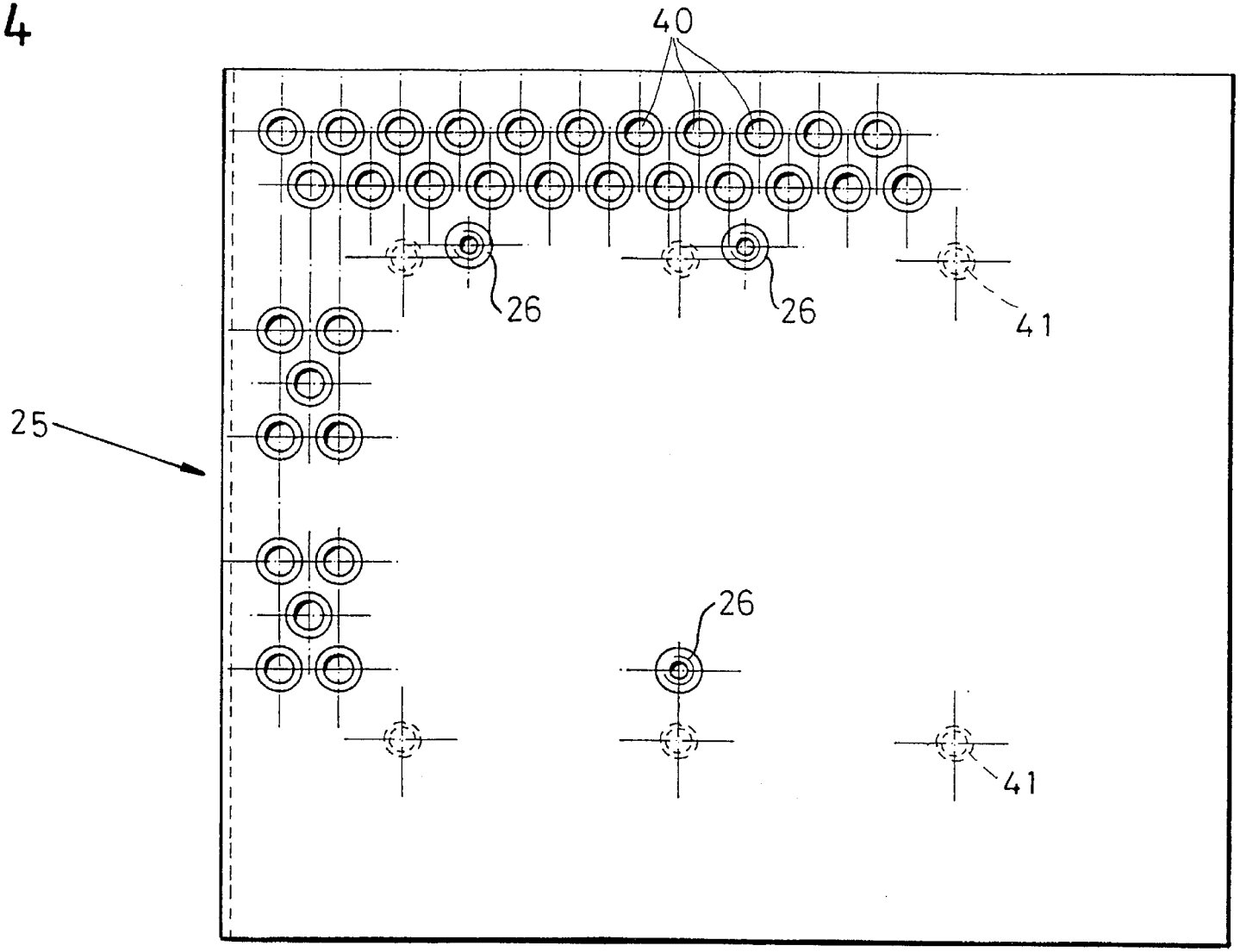
FIG. 4 is a side view of one of the side plates of the system.

According to the invention as seen in FIGS. 2, 3, and 4, each side plate 25 is formed with a plurality of holes 26, here two upper and one lower, each connected to a respective atomizer 29 forming part of a common spray system 30 and each connected through a valve box 31 with a pressure-controller 32. In turn this controller 32 is connected via a line 33 to a supply 43 of mold-release/lubricant oil and via a line 42 to a source 28 of pressurized air. A programmable computer-type controller 35 operates the pressure controller 32 and receives inputs via lines 34 from reed switches 36 associated with the actuators 37 for the upstream mold plate 17.

In addition as seen in FIG. 4, each side plate is formed with a peripheral array of vent holes 40 and with connection holes 41. Furthermore as seen in FIG. 3 each hole 26 is provided with a nozzle fitting 27 formed basically as a deflector 38 defining a narrow U-shaped or annular opening 39 through which the aerosol formed in the respective atomizer 29 is ejected into a cavity F defined by the plates 17, 19, 23, 24, and 25.

Figure 6:
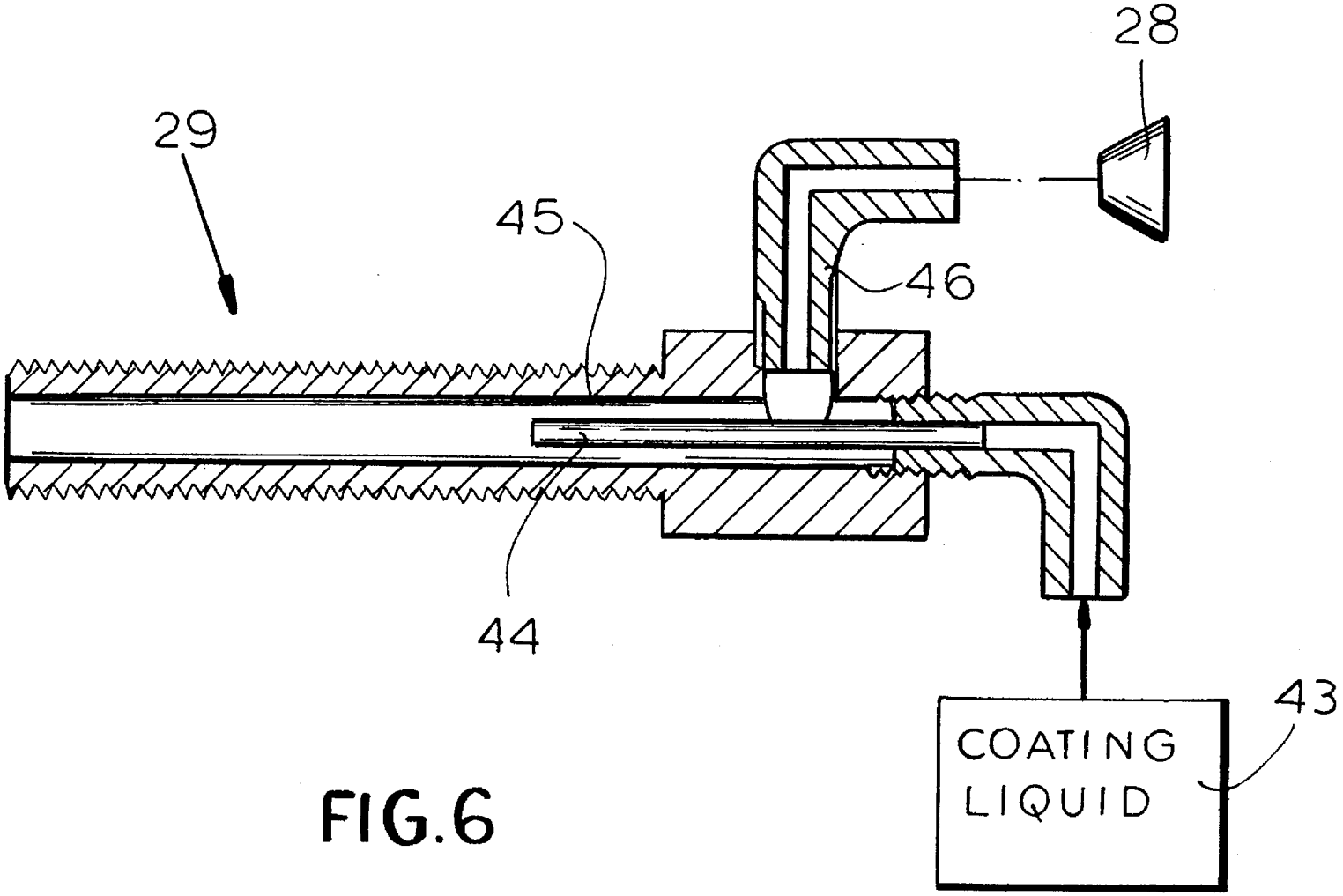
FIG. 6 is a sectional view of a detail of the atomizer of the invention.

FIG. 6 shows one of the atomizers 29 in detail. It has a lateral inlet 46 connected as described above to the air supply 28 and a central tube 44 connected to the supply 43 of coating liquid. The air at 6 bar to 8 bar moving at high speed forward in an annular space 45 past the tip of the tube 44 sucks the coating liquid therefrom and atomizes it into a finely divided liquid/gas suspension that can then be injected as a mist into the mold chamber F.

Figure 5A:
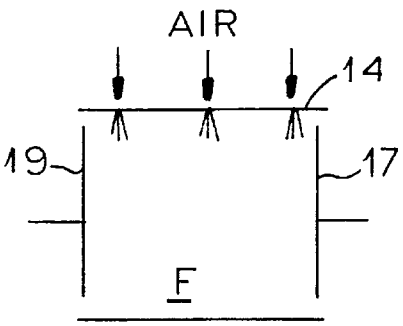
FIGS. 5A through 5F are diagrams illustrating the operation of the system of the invention, FIGS. 5A through 5D being vertical longitudinal sections and FIGS. 5E and 5F being horizontal longitudinal sections.
Figure 5B:
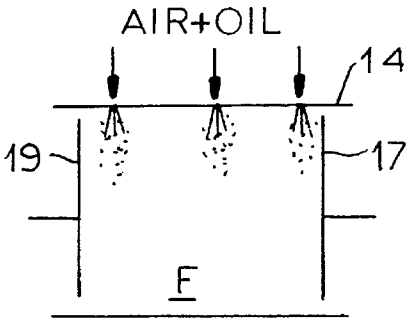
Figure 5C:
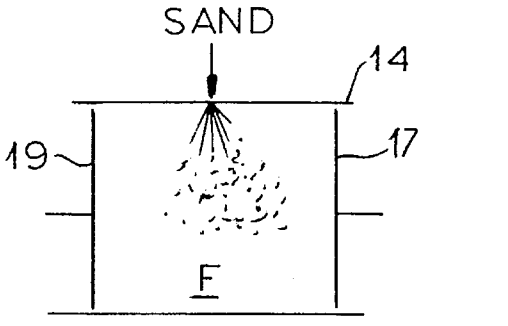
Figure 5D:
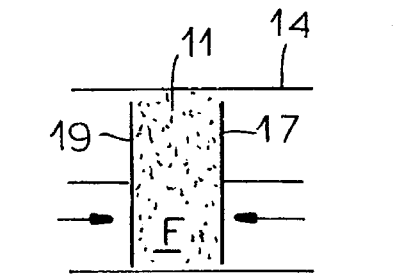
Figure 5E:
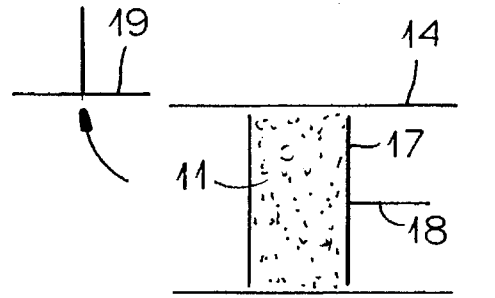
Figure 5F:
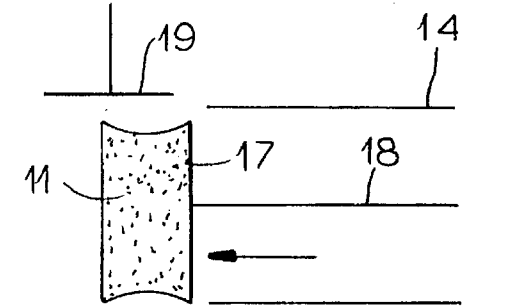

As seen in FIG. 5A through 5F, the system described above operates as follows:

First of all as shown in FIG. 5A the two plates 17 and 19 are moved into positions just barely closing the openings 15 and 16 and essentially closing the mold cavity F. The valve box 31 is then operated to blow air only out of the nozzles 26 to clear them of any sand that might be clogging them from a previous cycle. During this operation the holes 40 are open or can even be connected to a vacuum source to clear the chamber F of grit.

Then (FIG. 5B) air and oil are fed to the atomizers 29 so that an aerosol of the oil is ejected from the holes 26. Typically at least one such pulse is used, having a duration of 0.2 sec to 1.3 sec and a pressure of 4 bar to 10 bar. This aerosol is ejected from both side plates 25 so it uniformly fills the cavity F. Thus all the faces delimiting the cavity F will be uniformly coated with a thin coating of the oil in the aerosol. During this step the plates 17 and 19 may move.

Subsequently (FIG. 5C) mold sand is blown under pressure through the hole 13 into the cavity F and then (FIG. 5D) the plates 17 and 19 are moved in another 10 cm to 15 cm to compress this sand into the body 11.

The plate 19 (FIG. 5E) is then shifted back and swung out of the way, and the plate 17 (FIG. 5F) is pushed completely through the box 14 to eject the body 11 from it. Then the plates 17 and 19 are moved back into the position of FIG. 5A and the cycle may be repeated.

We claim:

1. A method of operating a molding system having a box having a pair of oppositely open ends and inner side faces, respective mold plates engageable in the open ends to close same and having faces defining with the inner side faces a mold cavity, and nozzles on the inner side faces, the method comprising the steps of sequentially:

a) setting the mold plates in a relatively widely spaced outer position so that the mold plates close the open ends of the box;

b) blowing only air from the nozzles to clear sand from them;

c) spraying from the nozzles into the mold cavity an aerosol mist under superatmospheric pressure and comprised of air and finely divided droplets of a coating liquid, whereby the droplets settle on the faces and coat the faces with the liquid;

d) introducing sand into the cavity between the faces and e) moving the mold plates together into a relatively closely spaced inner position to compress the sand in the cavity to form a mold part.

2. The method defined in claim 1 wherein the mist is sprayed under a pressure of between 4 bar 10 bar.

3. The method defined in claim 1, further comprising the step of forming the mist outside the cavity and conducting the mist to the cavity under superatmospheric pressure.

4. The method defined in claim 1, further comprising the step of aspirating air and particles from the mold cavity during step b).

5. A molding system comprising:

a box having a pair of oppositely open ends and inner side faces;

respective mold plates engageable in the open ends to close same and having faces defining with the inner side faces a mold cavity;

means for introducing sand into the cavity between the faces;

means for displacing the mold plates toward each other between a relatively widely spaced outer position to a relatively closely spaced inner position to compress the sand in the cavity to form a mold part;

at least one nozzle in one of the side faces of the box directed into the cavity; and means connected to the nozzle for spraying into the mold cavity when same is closed by the mold plates in the outer position thereof but before the sand is introduced into the cavity at first only air to clear sand from the nozzles and thereafter an aerosol mist under superatmospheric pressure and comprised of air and finely divided droplets of a coating liquid, whereby the droplets settle on the faces and coat same with the liquid.

6. The molding system defined in claim 5 wherein the means connected to the nozzle includes an atomizer outside the box for forming the aerosol mist.

7. The molding system defined in claim 5 wherein the means connected to the nozzle includes a supply of the coating liquid and a supply of air under pressure connected to the atomizer.

8. The molding system defined in claim 7 wherein each nozzle includes a forwardly open central tube connected to the supply of coating liquid, a housing defining with the central tube an annular space open forward into the cavity, and an inlet connected to the supply of air for pressurizing the space and thereby drawing the liquid from the central tube and atomizing the liquid.

9. The molding system defined in claim 5 wherein the nozzle is provided in a vertical side face of the box.

10. The molding system defined in claim 5 wherein each nozzle includes a deflector defining an at least partially annular gap through which the mist is ejected into the cavity.

* * * * *